US011644785B2

(12) United States Patent
Kim et al.

(10) Patent No.: US 11,644,785 B2
(45) Date of Patent: May 9, 2023

(54) PRINTER WITH PHOTODETECTOR FOR DETECTING FLUORESCENT ADDITIVES IN TONER

(71) Applicant: Hewlett-Packard Development Company, L.P., Spring, TX (US)

(72) Inventors: Eogkyu Kim, Seongnam-si (KR); Heungsup Park, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/557,871

(22) Filed: Dec. 21, 2021

(65) Prior Publication Data

US 2022/0113665 A1 Apr. 14, 2022

Related U.S. Application Data

(63) Continuation of application No. 16/981,360, filed as application No. PCT/US2019/023865 on Mar. 25, 2019, now Pat. No. 11,243,490.

(30) Foreign Application Priority Data

Apr. 13, 2018 (KR) ..... 10-2018-0043359

(51) Int. Cl.

| | |
|---|---|
| ***G03G 15/00*** | (2006.01) |
| ***G03G 9/08*** | (2006.01) |
| ***G03G 9/09*** | (2006.01) |

(52) U.S. Cl.

CPC ..... *G03G 15/5062* (2013.01); *G03G 9/0821* (2013.01); *G03G 9/0902* (2013.01)

(58) Field of Classification Search

CPC ..... G03G 15/5062; G03G 9/0821; G03G 9/0902; G03G 9/0906; B41J 29/393

See application file for complete search history.

(56) References Cited

U.S. PATENT DOCUMENTS

| | | | | |
|---|---|---|---|---|
| 6,272,248 | B1 | 8/2001 | Saitoh et al. | |
| 7,945,178 | B2 * | 5/2011 | Toyohara | G03G 15/0131 399/72 |
| 2003/0005303 | A1 | 1/2003 | Auslander et al. | |
| 2003/0215249 | A1 * | 11/2003 | Shinkawa | G03G 21/043 399/49 |
| 2003/0219262 | A1 | 11/2003 | Doi | |
| 2005/0219305 | A1 | 10/2005 | Kikuchi et al. | |

(Continued)

FOREIGN PATENT DOCUMENTS

| | | | |
|---|---|---|---|
| CN | 1636225 | A | 7/2005 |
| CN | 202676597 | U | 1/2013 |

(Continued)

*Primary Examiner* — Hoang X Ngo

(74) *Attorney, Agent, or Firm* — Brooks, Cameron & Huebsch, PLLC

(57) ABSTRACT

An example photodetector for detecting fluorescent toner includes a light emitting unit to emit light to a toner image, and a light receiving unit. The light receiving unit is to detect visible light reflected by the toner image, detect that the toner image includes the fluorescent toner based on the detection of the visible light, the visible light generated by the fluorescent toner and having a predetermined wavelength band different from a wavelength band of the emitted light, and output a signal corresponding to the detection of the fluorescent toner.

20 Claims, 6 Drawing Sheets

(56) References Cited

U.S. PATENT DOCUMENTS

| | | | | |
|---|---|---|---|---|
| 2006/0220260 | A1 | 10/2006 | Takahashi | |
| 2008/0056752 | A1 | 3/2008 | Denton et al. | |
| 2008/0118253 | A1 | 5/2008 | Abe | |
| 2009/0035690 | A1 | 2/2009 | Blood et al. | |
| 2009/0220260 | A1* | 9/2009 | Denton ..... | G03G 9/0902 430/108.1 |
| 2010/0322648 | A1 | 12/2010 | Kojima et al. | |
| 2011/0063640 | A1 | 3/2011 | Tanaka | |
| 2012/0139985 | A1 | 6/2012 | Powers et al. | |
| 2016/0091816 | A1 | 3/2016 | Kochi | |
| 2016/0147177 | A1 | 5/2016 | Isoda | |

FOREIGN PATENT DOCUMENTS

| | | | |
|---|---|---|---|
| CN | 105629688 | A | 6/2016 |
| JP | 2002-304024 | A | 10/2002 |
| JP | 2004-348539 | A | 12/2004 |
| JP | 2008-006615 | A | 1/2008 |
| JP | 2011-48297 | A | 3/2011 |
| WO | WO-2013/112899 | A2 | 8/2013 |

* cited by examiner

PRINTER WITH PHOTODETECTOR FOR DETECTING FLUORESCENT ADDITIVES IN TONER

BACKGROUND

A printer using an electrophotographic method supplies toner to an electrostatic latent image formed on a photoconductor to form a visible toner image on the photoconductor, transfers the toner image to a print medium via an intermediate transfer medium or directly, and fixes the transferred toner image on the print medium.

Print quality may depend on the toner and printing conditions of a printer may be set according to the toner. A stable printed image may be obtained when the type of toner and the printing conditions are matched with each other.

The toner is accommodated in a toner cartridge, and the toner cartridge is mounted in the printer. When the toner in the toner cartridge is exhausted, the toner cartridge may be replaced with a new toner cartridge. An electronic identification device containing information on the toner may be provided in the toner cartridge. When the toner cartridge is mounted in a printer, the electronic identification device is electrically connected to a controller provided in the printer, and the information on the toner may be transmitted to the controller.

BRIEF DESCRIPTION OF DRAWINGS

The above and other aspects, features, and advantages of certain examples of the present disclosure will be more apparent from the following description taken in conjunction with the accompanying drawings, in which.

Throughout the drawings, it should be noted that like reference numbers are used to depict the same or similar elements, features, parts, components, and structures.

DETAILED DESCRIPTION

Reference will now be made to examples, which are illustrated in the accompanying drawings. In this regard, the examples may have different forms and should not be construed as being limited to the descriptions set forth herein. In order to further clearly describe features of the examples, descriptions of other features that are well known to one of ordinary skill in the art are omitted here.

In the specification, when an element is "connected" to another element, the elements may not only be "directly connected," but may also be "indirectly connected" via another element therebetween. Also, when a region "includes" an element, the region may further include another element instead of excluding the other element, unless otherwise differently stated.

Expressions such as "at least one of," when preceding a list of elements, modify the entire list of elements and do not modify the individual elements of the list.

Figure 1:
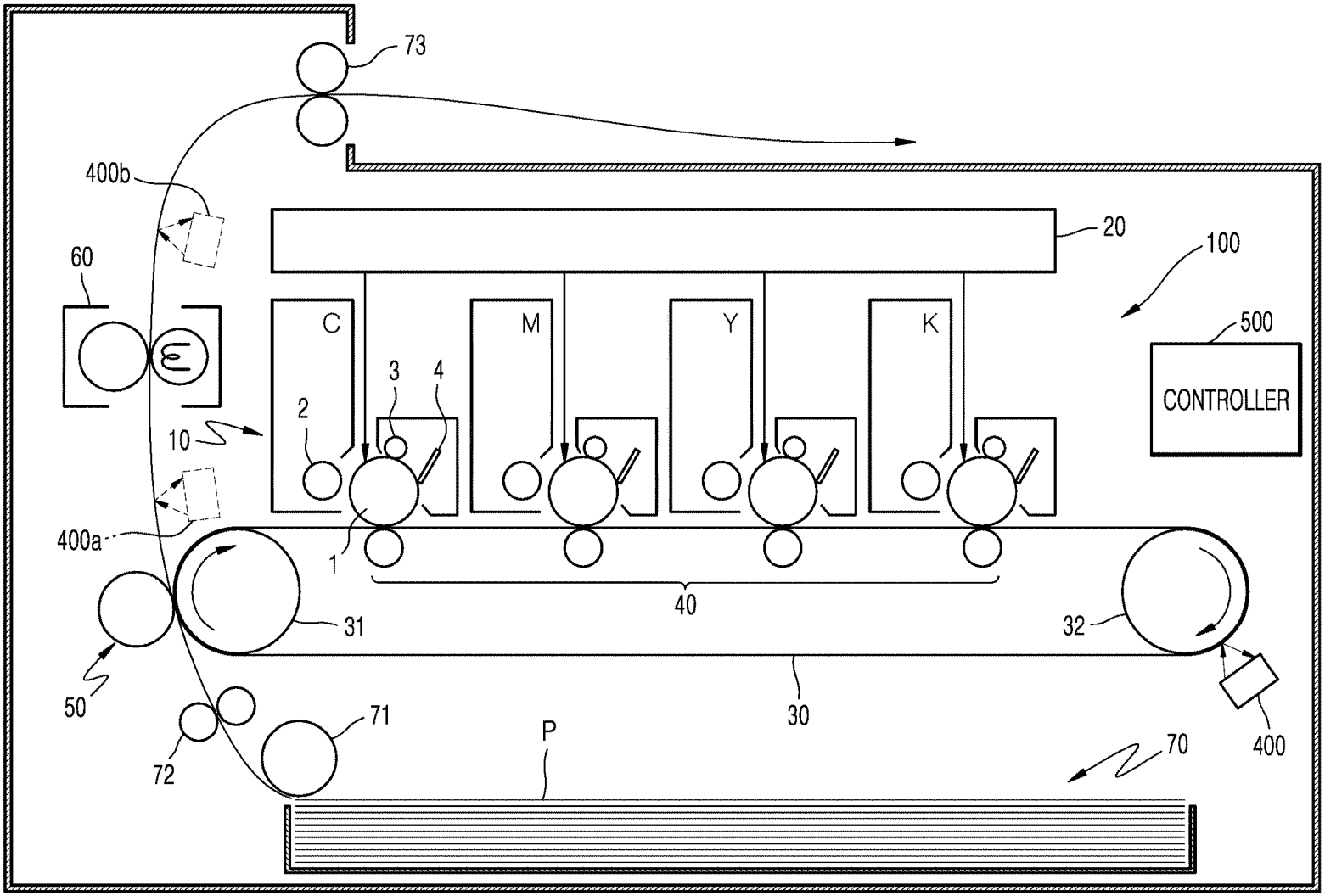
FIG. 1 is a view illustrating a configuration of a printer according to an example.

FIG. 1 is a view illustrating a configuration of a printer according to an example.

Referring to FIG. 1, the printer prints an image on a print medium P by using an electrophotographic method. In an example, the printer prints a color image on the print medium P.

The printer may include an image forming unit 100, a photodetector 400, and a controller 500. The image forming unit 100 forms a toner image on an image receptor by using a toner containing fluorescent additives that reflect light in a certain wavelength band in response to light in an invisible wavelength band, transfers the toner image to a print medium, and fixes the toner image to the print medium. The photodetector 400 includes a light emitting unit for emitting light in an invisible wavelength band to a toner image accommodated in any one of the image receptor and the print medium P and a light receiving unit for detecting light reflected from the toner image. The controller 500 controls a printing operation of the printer based on a detection signal of the light receiving unit.

The image forming unit 100 may include a plurality of photosensitive drums 1, a plurality of developing units 10, an exposure unit 20, an intermediate transfer belt 30, a transfer unit, and a fusing unit 60. The photosensitive drum 1, which is an example of a photoconductor having a surface on which an electrostatic latent image is formed, may include a conductive metal pipe and a photosensitive layer formed on the periphery thereof. The plurality of developing units 10 correspond to the plurality of photosensitive drums 1, respectively. The plurality of developing units 10 supply toner to electrostatic latent images formed on the plurality of photosensitive drums 1 and form toner images on the surfaces of the plurality of photosensitive drums 1, respectively. Each of the plurality of developing units 10 may be replaced separately from the plurality of photosensitive drums 1. Furthermore, each of the plurality of developing units 10 may be in the form of a replaceable cartridge including a photosensitive drum 1.

For color printing, the plurality of developing units 10 may include a plurality of developing units 10Y, 10M, 10C, and 10K that accommodate toners of yellow, magenta, cyan, and black, respectively. In addition to the above-mentioned colors, developing units that accommodate toners of various colors such as light magenta, white, and a transparent color may be further employed. Hereinafter, a printer including the plurality of developing units 10Y, 10M, 10C, and 10K will be described. Unless otherwise mentioned, reference numerals with Y, M, C, and K refer to components for printing images by using toners of yellow, magenta, cyan, and black, respectively.

Each of the developing units 10 supplies toner accommodated therein to an electrostatic latent image formed in the photosensitive drum 1 corresponding to the developing unit 10 and develops the electrostatic latent image into a visible toner image. The developing unit 10 may include a developing roller 2. The developing roller 2 supplies the toner in the developing unit 10 to the photosensitive drum 1. A developing bias voltage may be applied to the developing roller 2. A regulating member (not shown) regulates the amount of toner supplied by the developing roller 2 to a developing zone where the photosensitive drum 1 and the developing roller 2 face each other.

When a two-component developing method is employed, a magnetic carrier and toner may be accommodated in the developing unit 10. The developing roller 2 may be positioned away from the photosensitive drum 1 by tens to hundreds of microns. Although not shown in the drawings, the developing roller 2 may be in a form in which a magnetic roller is arranged in a hollow cylindrical sleeve. The toner is attached to the surface of the magnetic carrier and the magnetic carrier is attached to the surface of the developing roller 2. The toner and magnetic carrier are carried to the developing zone where the photosensitive drum 1 and the developing roller 2 face each other. However, only the toner is supplied to the photosensitive drum 1 by a developing bias voltage applied between the developing roller 2 and the photosensitive drum 1 to thereby develop an electrostatic latent image formed on the surface of the photosensitive drum 1 into a visible toner image. The developing unit 10 may include an agitator (not shown) that mixes and agitates the toner with the magnetic carrier and transports the toner mixed and agitated with the magnetic carrier to the developing roller 2. The agitator may be, for example, an auger and the developing unit 10 may be provided with a plurality of agitators.

When a one-component developing method, which does not use a carrier, is employed, the developing roller 2 may be rotated in contact with the photosensitive drum 1. The developing roller 2 may be rotated while spaced from the photosensitive drum 1 from tens to hundreds of microns. The developing unit 10 may further include a supply roller (not shown) for attaching the toner to a surface of the developing roller 2. A supply bias voltage may be applied to the supply roller. The developing unit 10 may further include an agitator (not shown). The agitator may agitate the toner and triboelectrically charge the toner. The agitator may be, for example, an auger.

A charging roller 3 is an example of a charger that charges the photosensitive drum 1 to have a uniform surface potential. A charging bias voltage is applied to the charging roller 3. According to various examples, a charging brush, a corona charger, or the like may be employed instead of the charging roller 3. A cleaning blade 4 is an example of a cleaning member that removes foreign matter and toner remaining on the surface of the photosensitive drum 1 after a transfer process. According to various examples, other types of cleaning devices, such as a rotating brush, may also be employed instead of the cleaning blade 4.

The exposure unit 20 irradiates modulated light corresponding to image information to photosensitive drums 1Y, 1M, 1C, and 1K and forms electrostatic latent images corresponding to yellow Y, magenta M, cyan C, and black K images on the photosensitive drums 1Y, 1M, 1C, and 1K, respectively. As the exposure unit 20, a laser scanning unit (LSU) using a laser diode as a light source, and an exposure unit using a light emitting diode (LED) as a light source may be employed.

The intermediate transfer belt 30 may be supported by, for example, support rollers 31 and 32, and may circulate based on rotation of the support rollers 31 and 32. A plurality of intermediate transfer rollers 40 may be arranged at positions facing the photosensitive drums 1Y, 1M, 1C, and 1K with the intermediate transfer belt 30 therebetween. The plurality of intermediate transfer rollers 40 are examples of an intermediate transfer unit for transferring a toner image from the photosensitive drums 1Y, 1M, 1C, and 1K to the intermediate transfer belt 30. An intermediate transfer bias voltage for transferring a toner image to the intermediate transfer belt 30 may be applied to the plurality of intermediate transfer rollers 40. According to various examples, a corona transfer unit, a pin scorotron transfer unit, or the like may be employed instead of each of the intermediate transfer rollers 40.

The print medium P is picked up one by one from a loading table 70 by a pickup roller 71 and is fed to an area, in which the intermediate transfer belt 30 and a transfer roller 50 face each other, by a feed roller 72. The transfer roller 50 is an example of a transfer unit that transfers a toner image from the intermediate transfer belt 30 to the print medium P. A transfer bias voltage that is used for transferring a toner image to the intermediate transfer belt 30 may be applied to the transfer roller 50.

The fusing unit 60 may fix the print medium P by applying heat and pressure to a toner image transferred to the print medium P. The print medium P having passed through the fusing unit 60 is discharged by a discharge roller 73.

According to the above example, when a print command is input, the exposure unit 20 scans a plurality of light beams modulated corresponding to image information of each color to the photosensitive drums 1Y, 1M, 1C, and 1K to thereby form an electrostatic latent image. The plurality of developing units 10Y, 10M, 10C, and 10K supply Y, M, C, and K color toners to electrostatic latent images formed on the photosensitive drums 1Y, 1M, 1C, and 1K, respectively, and form visible toner images of Y, M, C, and K colors on the surfaces of the photosensitive drums 1Y, 1M, 1C, and 1K, respectively. The visible toner images of Y, M, C, and K colors are transferred to the intermediate transfer belt 30 by the intermediate transfer bias voltage applied to the intermediate transfer rollers 40. The print medium P loaded on the loading table 70 is fed to the area, in which the intermediate transfer belt 30 and the transfer roller 50 face each other, by the pickup roller 71 and the feed roller 72. Toner images of Y, M, C, and K colors on the intermediate transfer belt 30 are transferred onto the print medium P by a transfer bias voltage applied to the transfer roller 50. When the print medium P passes through the fusing unit 60, the toner images are fixed to the print medium P by heat and pressure. The print medium P having been fixed is discharged by the discharge roller 73. The above-described printing process is controlled by the controller 500, which may include at least one central processing unit, or other processor.

The quality of a printed image depends on the physical properties of the toner and the printer may reliably secure the quality of the printed image by applying printing conditions that match the physical properties of the toner. To this end, it is necessary to identify the toner used for printing. In an example, a printer uses a toner containing fluorescent additives that reflect light in a certain wavelength band in response to light in an invisible wavelength band. To avoid affecting the visibility of a printed image, the fluorescent additives do not react to light in a visible wavelength band. However, since the fluorescent additives receive light in an invisible wavelength band and reflect light in a certain wavelength band, it is possible to determine which toner is used for printing by detecting the light in the certain wavelength band reflected by the fluorescent additives.

The fluorescent additives may be included in a toner as an external additive or as an internal additive and the type of fluorescent additives is not particularly limited. In an example, the fluorescent additives may include quantum dot-encoded additives (QDEA). Quantum dots are very small semiconductor particles with sizes on the order of a few nanometers and are different from ordinary particles with different electrical and optical properties. The quantum dots absorb light of a certain wavelength and emit light of a certain wavelength. Accordingly, fluorescent additives that generate light in a certain wavelength band in response to light in an invisible wavelength band may be realized by the quantum dots. The luminous efficiency of the fluorescent additives may be improved by treating the above-described QDEA with a nonionic organic dispersant. Furthermore, by adding a halogen-based element to an organic ligand on a surface of a quantum dot, light resistance may be improved. The fluorescent additives may generate light in a wavelength band of about 380 nm to about 1000 nm. For example, the fluorescent additives may generate at least one light with a bandwidth of 60 nm or less in the wavelength band of about 380 nm to about 1000 nm. The fluorescent additives may generate light in a visible wavelength band, for example, a wavelength band of about 450 nm to about 700 nm. For example, the fluorescent additives may generate one or more light with a bandwidth of 40 nm or less in the wavelength band of about 450 nm to about 700 nm. Hereinafter, light generated in the fluorescent additives via the light in the invisible wavelength band is referred to as reflected light.

Referring to FIG. 1, the printer of the illustrated example includes the photodetector 400. The photodetector 400 irradiates light in an invisible wavelength band to a toner image accommodated in any one of the image receptor and the print medium P and detects reflected light from the toner image. The image receptor, which is a member on which a toner image is formed, may be, for example, the photosensitive drum 1 or the intermediate transfer belt 30. The photodetector 400 may irradiate light in an invisible wavelength band to a toner image on the photosensitive drum 1 or the intermediate transfer belt 30 and detect reflected light from the toner image. The photodetector 400 may irradiate light in an invisible wavelength band to a toner image on a print medium P before passing through the fusing unit 60 or a printing medium P after passing through the fusing unit 60 and detect reflected light from the toner image.

Figure 2:
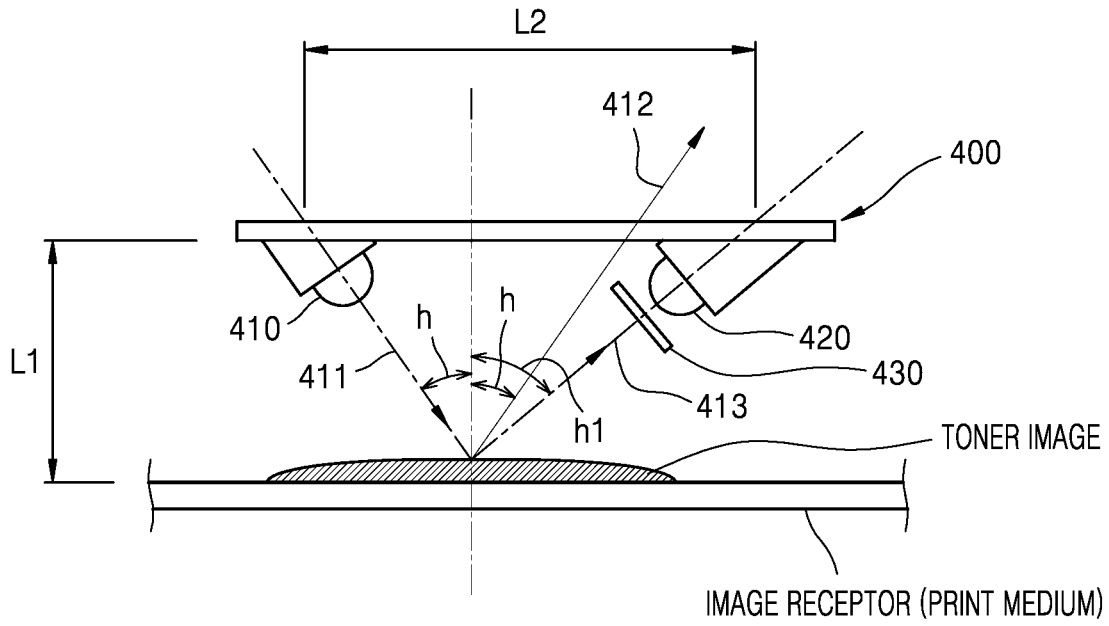
FIG. 2 is a view illustrating a configuration of a photodetector according to an example.

FIG. 2 is a view illustrating a configuration of a photodetector according to an example.

Referring to FIG. 2, the photodetector 400 may include a light emitting unit 410, for emitting light in an invisible wavelength band to a toner image accommodated in any one of the image receptor and the print medium P, and a light receiving unit 420, for detecting reflected light from the toner image. The light emitting unit 410 may irradiate, for example, ultraviolet light, infrared light, or other wavelength bands of light to the toner image. The light receiving unit 420 may be arranged to receive scattered light 413 instead of regularly reflected light 412. To this end, the light receiving unit 420 may be arranged to receive light having a reflection angle h1 different from an angle h of incident light 411 with respect to a line perpendicular to the toner image. The scattered light 413, which is light having an averaged light intensity, is less susceptible to light detection with respect to the installation angle of the light receiving unit 420, and thus, stable light detection is possible.

In an example, the light receiving unit 420 may receive light in a wavelength band of about 380 nm to about 1000 nm. The light receiving unit 420 may receive light in a visible wavelength band, for example, light in a wavelength band of about 450 nm to about 700 nm. An optical filter 430 may be at a front end of the light receiving unit 420 to limit the wavelength band of light incident on the light receiving unit 420. The optical filter 430 may pass light in a wavelength band of, for example, about 380 nm to about 1000 nm. In this case, the bandwidth of the optical filter 430 may be 200 nm or less. The optical filter 430 may pass light in a wavelength band of, for example, about 450 nm to about 700 nm. In this case, the bandwidth of the optical filter 430 may be 100 nm or less. By limiting the bandwidth of light received by the light receiving unit 420, interference due to external light may be reduced and the accuracy of reflected light detection may be improved.

In an example, a distance L1 between the photodetector 400 and an image receptor or print medium P may be within 10 mm. A distance L2 between the light emitting unit 410 and the light receiving unit 420 depends on the distance L1 between the photodetector 400 and the image receptor or the print medium P. As the distance L1 between the photodetector 400 and the image receptor or the print medium P increases, the distance L2 between the light emitting unit 410 and the light receiving unit 420 also increases. As the distances L1 and L2 increase, a space occupied by the photodetector 400 in the printer increases, and thus it may not be easy to arrange the photodetector 400. In addition, it is difficult to implement a photodetector 400 that is small and has the light emitting unit 410 and the light receiving unit 420 integrated therein. The distance L1 between the photodetector 400 and the image receptor or the print medium P may be within 10 mm so that the distance L2 between the light emitting unit 410 and the light receiving unit 420 may be within 30 mm. Thus, the miniaturization of the photodetector 400 is possible, and it is possible to implement a photodetector 400 that is small and has the light emitting unit 410 and the light receiving unit 420 integrated therein.

Referring again to FIG. 1, the photodetector 400 is arranged to face the intermediate transfer belt 30. The photodetector 400 irradiates light in an invisible wavelength band to a toner image on the intermediate transfer belt 30 and receives light reflected from the toner image.

Figure 3:
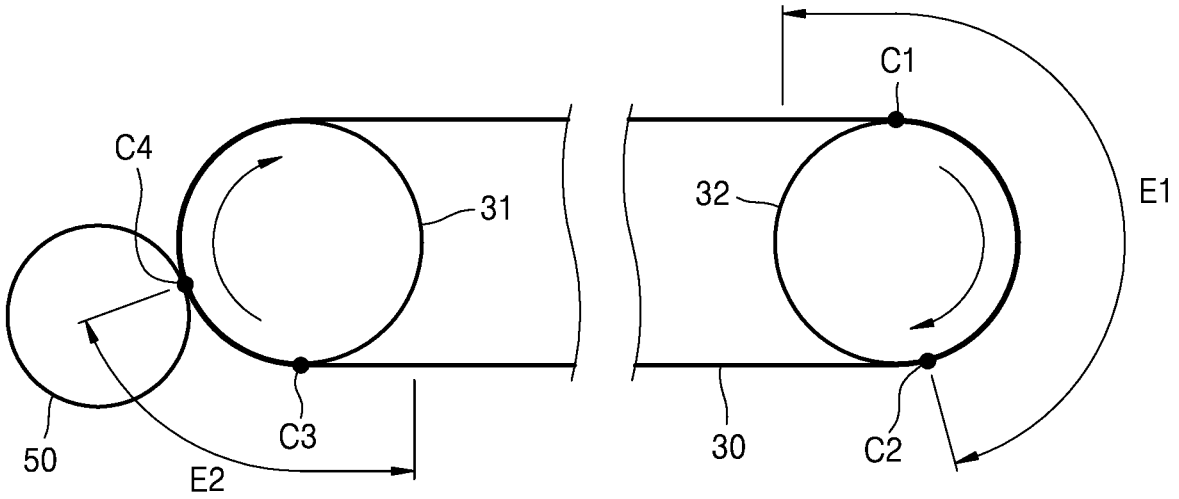
FIG. 3 is a view showing an installation position of a photodetector arranged to face an intermediate transfer belt according to an example.

FIG. 3 is a view showing an installation position of a photodetector arranged to face an intermediate transfer belt according to an example.

Referring to FIG. 3, the photodetector 400 may be arranged to face a tension side of the intermediate transfer belt 30. As illustrated in the example of FIG. 3, the support roller 32 is rotated clockwise. The tension side is an area E1 from a position close to a position C1 at which the intermediate transfer belt 30 and the support roller 32 start to contact each other to a position C2 at which the contact between the intermediate transfer belt 30 and the support roller 32 is terminated. An area after the position C2 is a relaxation side. On the relaxation side, the intermediate transfer belt 30 may be loosened and be shaken or vibrate while running. In that case, the distance between the intermediate transfer belt 30 and the photodetector 400 may change, and the accuracy of reflected light detection may be lowered. The photodetector 400 may be arranged to face the tension side of the intermediate transfer belt 30 to thereby reduce reflected light detection errors and improve detection accuracy. When the photodetector 400 is arranged to face an area where the intermediate transfer belt 30 and the support roller 32 contact each other, that is, an area between the position C1 and the position C2, reflected light may be detected more stably. When the support roller 31 is a reference, an area E2 between a position immediately before a position C3 at which the support roller 31 and the intermediate transfer belt 30 start to contact each other and a position C4 at which the intermediate transfer belt 30 and the transfer roller 50 contact each other is also a tension side.

Figure 4:
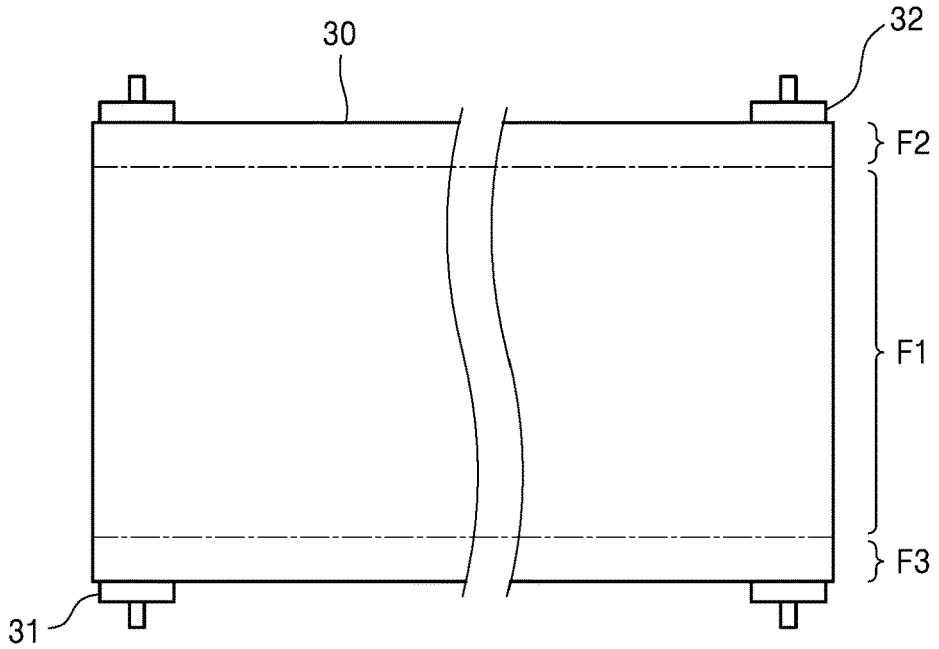
FIG. 4 is a view showing an installation position of a photodetector arranged to face an intermediate transfer belt according to an example.

FIG. 4 is a view showing an installation position of a photodetector arranged to face an intermediate transfer belt according to an example.

Referring to FIG. 4, the photodetector 400 may be arranged to face an image area F1 of the intermediate transfer belt 30. In this case, a toner image transferred to the intermediate transfer belt 30 and detected by the photodetector 400 may be a toner image for printing. The toner image transferred to the intermediate transfer belt 30 and detected by the photodetector 400 may not be a toner image for printing but may be a detection toner image for detecting the type of toner. The photodetector 400 may be arranged to face a non-image area F2 or F3 of the intermediate transfer belt 30. In this case, a toner image transferred to the intermediate transfer belt 30 and detected by the photodetector 400 is a detection toner image for detecting the type of toner.

In an example, the photodetector 400 may be arranged to face the photosensitive drum 1. The photodetector 400 irradiates light in an invisible wavelength band to a toner image on the photosensitive drum 1, and receives light reflected from the toner image.

Figure 5:
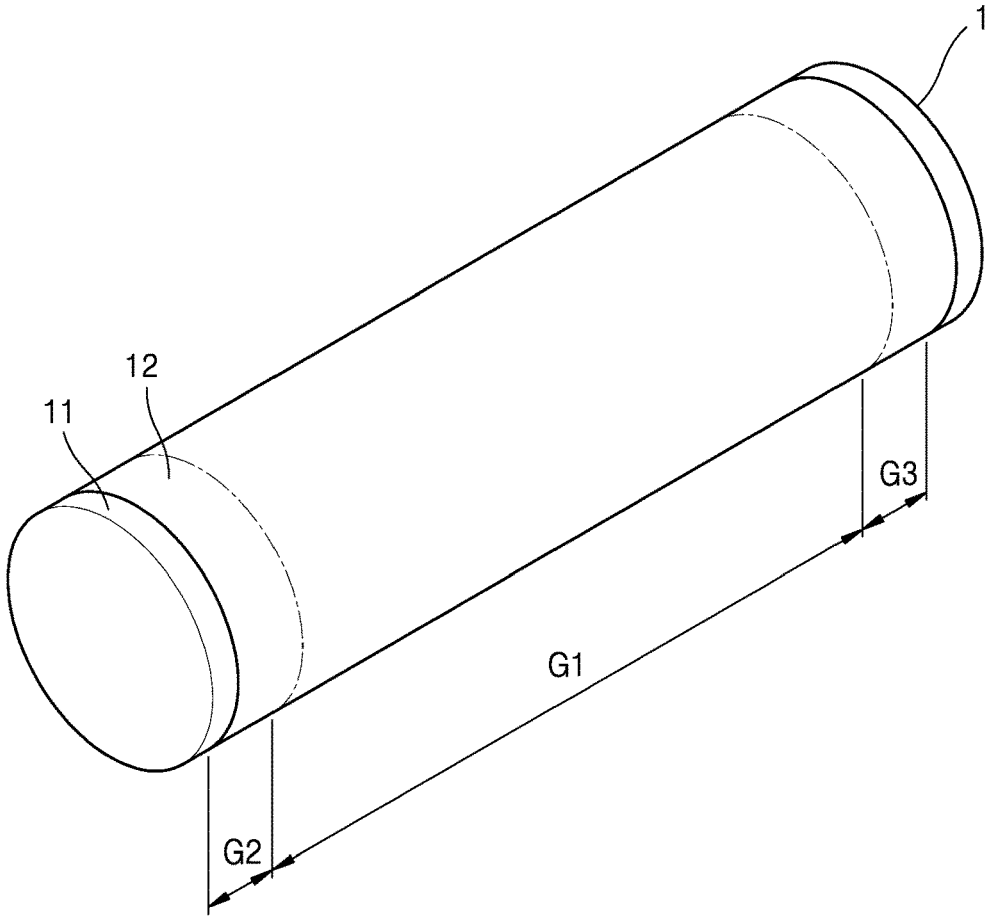
FIG. 5 is a view showing an installation position of a photodetector arranged to face a photosensitive drum according to an example.

FIG. 5 is a view showing an installation position of a photodetector arranged to face a photosensitive drum according to an example.

Referring to FIG. 5, the photodetector 400 may be arranged to face a non-image area G2 or G3 positioned on both sides of an image area G1 of the photosensitive drum 1. The photosensitive drum 1 includes a conductive metal pipe 11 and a photosensitive layer 12 formed on the periphery of the conductive metal pipe 11. The length of the photosensitive layer 12 is longer than the length of the image area G1. The non-image areas G2 and G3 are areas where the photosensitive layer 12 is formed on both sides of the image area G1. An organic photosensitive layer is mainly used as the photosensitive layer 12. When light is irradiated on the organic photosensitive layer, the properties of the organic photosensitive layer may be changed and image quality may be deteriorated. In view of this, the photodetector 400 is arranged to face the non-image area G2 or G3 of the photosensitive drum 1. In this case, a toner image transferred to the photosensitive drum 1 and detected by the photodetector 400 is not a toner image for printing but is a detection toner image for detecting the type of toner.

The installation position of the photodetector 400 is not limited to the above-described example. The photodetector 400 may be installed such that the photodetector 400 faces a print medium P on which a toner image is transferred. As indicated by a reference numeral 400*a* in FIG. 1, the photodetector 400 may be positioned to face a print medium P before passing through the fusing unit 60. As indicated by a reference numeral 400*b* in FIG. 1, the photodetector 400 may be positioned to face a print medium P that has passed through the fusing unit 60.

Figure 6:
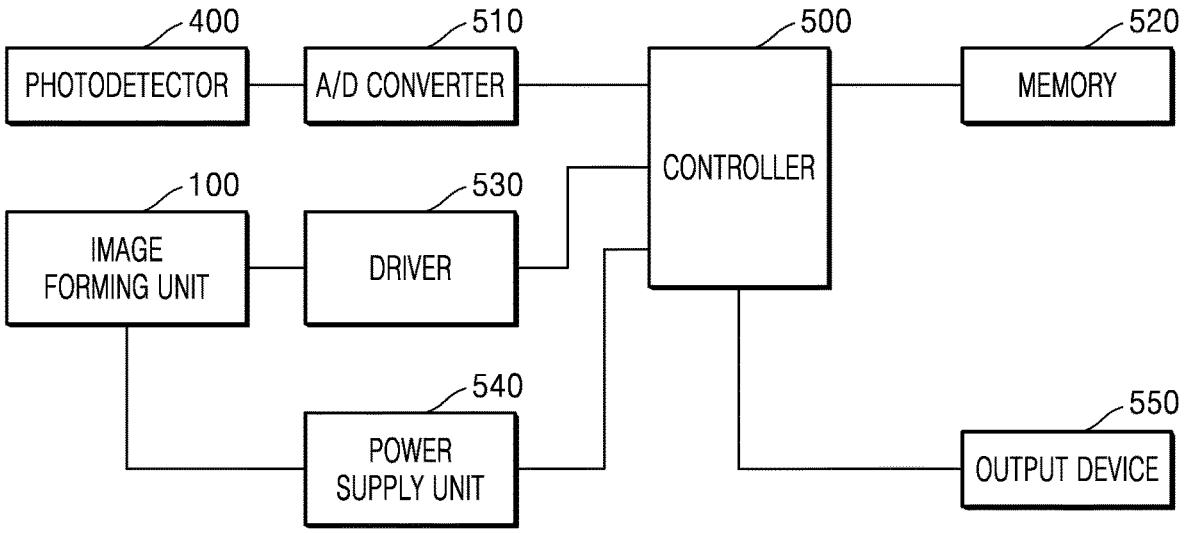
FIG. 6 is a block diagram of a control block of a printer according to an example.

FIG. 6 is a block diagram of a control block of a printer according to an example.

Referring to FIG. 6, the printer may include a driver 530 for driving the image forming unit 100 shown in FIG. 1. The driver 530 may include motors for driving components of the image forming unit 100, for example, motors for driving the photosensitive drum 1, the developing roller 2, the intermediate transfer belt 30, the intermediate transfer roller 40, the transfer roller 50, the fusing unit 60, the rollers 71, 72 and 73, and the exposure unit 20, a motor drive circuit, a temperature control circuit of the fusing unit 60, and the like. A power supply unit 540 may supply the image forming unit 100 with a charging bias voltage, a developing bias voltage, a transfer bias voltage, a heating voltage for heating the fusing unit 60, and the like.

A printing process will be described with reference to FIGS. 1 to 6.

When a print command is input from a host (not shown), a controller 500 controls the image forming unit 100 to form a toner image. The controller 500 controls the photodetector 400 to detect reflected light from the toner image. Light in an invisible wavelength band is irradiated from the light emitting unit 410 to a toner image on the photosensitive drum 1, the intermediate transfer belt 30, or the print medium P, and reflected light from the toner image is received by the light receiving unit 420.

A toner image formed by the image forming unit 100 may be a toner image for printing and may also be a detection toner image for determining the type of toner. As described above, when the photodetector 400 is arranged to face the intermediate transfer belt 30, the toner image formed by the image forming unit 100 may be a toner image for printing or a detection toner image. When the photodetector 400 is arranged to face the photosensitive drum 1, a toner image formed in the non-image area G2 or G3 (see FIG. 5) by the image forming unit 100 may be a detection toner image.

A detection signal of the light receiving unit 420 may be converted into a digital value by an analog to digital (ND) converter 510 and the digital value may be input to the controller 500. The detection signal of the light receiving unit 420 may be input to the A/D converter 510 through an amplifier (not shown) if necessary. The controller 500 determines the type of toner based on the input detection signal. For example, when a detection signal in an ON state is input to the controller 500, the controller 500 may recognize that the toner contains fluorescent additives. When a detection signal in an OFF state is input to the controller 500, the controller 500 may recognize that the toner does not contain the fluorescent additives. The controller 500 may control a printing operation of the image forming unit 100 according to the type of the detection signal. In other examples, the control operation of the controller 500 may vary.

For example, when a detection signal in an ON state is input to the controller 500, that is, when fluorescent additives are detected, the controller 500 may recognize a toner accommodated in the developing unit 10 as a reference toner of the printer. The controller 500 may control the image forming unit 100 to print an image by applying predefined printing parameters. For example, the controller 500 may control the image forming unit 100 to fetch printing parameters corresponding to the reference toner from a memory 520 and to print an image by applying the fetched printing parameters. The printing parameters may include at least one of, for example, the magnitude of a charging bias voltage, the magnitude of a developing bias voltage, the magnitude of a transfer bias voltage, a printing speed, a fusing temperature of the fusing unit 60, or the like. The controller 500 may control the power supply unit 540 to supply the image forming unit 100 with at least one of a charging bias voltage, a developing bias voltage, or a transfer bias voltage corresponding to the reference toner. The controller 500 may control the driver 530 such that the image forming unit 100 is driven at a printing speed corresponding to the reference toner. The controller 500 may control the driver 530 such that the fusing unit 60 is maintained at a fusing temperature corresponding to the reference toner. With this configuration, the quality of a printed image may be increased.

In an example, the printer may be a security printer that prints security documents. The toner containing fluorescent additives may be a toner (security toner) for printing security documents. When a security document is passed through a tester that irradiates light in an invisible wavelength band, reflected light in a certain wavelength band is generated by fluorescent additives included in the security toner, and thus, the security document may be prevented from being exposed to the outside. The toner may be accommodated in the developing unit 10 and the developing unit 10 may be replaced when the toner accommodated therein is exhausted. The toner may be accommodated in a replaceable toner cartridge (not shown) and supplied to the developing unit 10. To print a security document, it is necessary to check whether a security toner is accommodated in the developing unit 10 or a toner cartridge.

When a detection signal in an ON state is input from the photodetector 400, that is, when fluorescent additives are detected, the controller 500 may determine that a toner accommodated in the printer is a security toner. The controller 500 may control the image forming unit 100 to print a security document. The security toner may have different physical properties from ordinary toner. The controller 500 may control the image forming unit 100 to fetch printing parameters corresponding to the physical properties of the security toner from the memory 520 and to print a security document by applying the fetched printing parameters. When a detection signal in an OFF state is input from the photodetector 400, that is, when fluorescent additives are not detected, the controller 500 may determine that a toner accommodated in the printer is not a security toner. In an example, the controller 500 may control the image forming unit 100 to stop printing a security document and may output a security printing error signal via an output device 550. The output device 550 may be, for example, a buzzer, a display, an equalizer, a monitor connected to a user's host device, or the like. With this configuration, reliability as a security printer may be secured.

Figure 7:
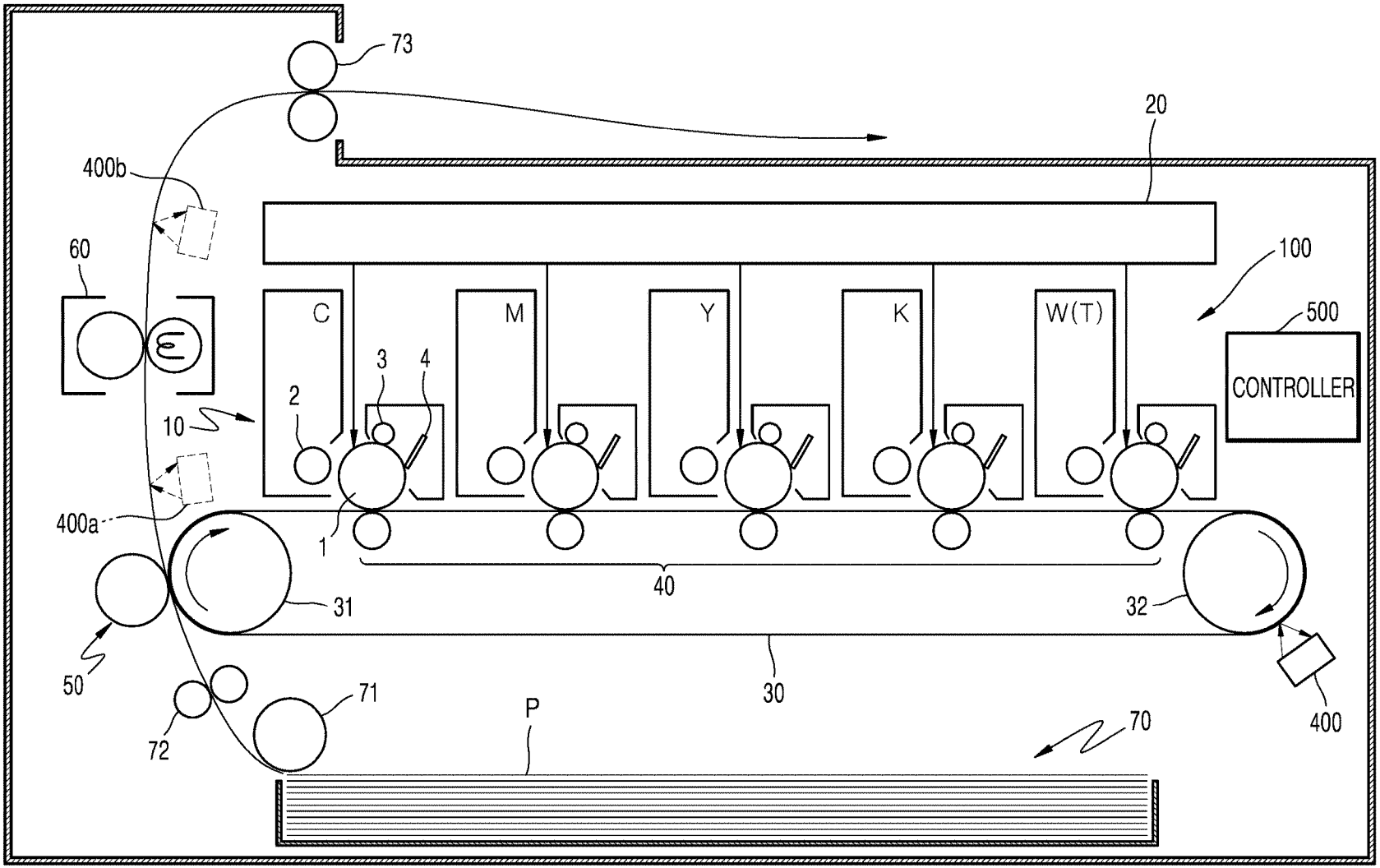
FIG. 7 is a view illustrating a configuration of a printer according to an example.

FIG. 7 is a view illustrating a configuration of a printer according to an example.

Referring to FIG. 7, a printer is illustrated that is different from the printer shown in FIG. 1 in that the printer shown in FIG. 7 includes a developing unit 10 in which at least one of white toner W or transparent toner T is accommodated. The white toner W or the transparent toner T includes fluorescent additives that receive light in an invisible wavelength band and generate reflected light in a certain wavelength band (e.g., a visible wavelength band). When a document such as a security document is printed, the entire document may be printed using the white toner W or the transparent toner T. According to this configuration, it is possible to print a document such as a security document in which the contents thereof may not be seen under visible light and may be confirmed under light in an invisible wavelength band. When a security document is printed, the contents thereof may be printed using monochromatic or color images, and identification information of the security document, for example, the creator of the security document, a person printing the security document, a printing place, or the like may be printed using the white toner W or the transparent toner T.

In an example, a toner containing fluorescent additives and a photodetector 400 for detecting the toner may be used for image density correction. The density of a printed image is influenced by various environmental factors such as temperature, humidity, or the like as well as printing parameters such as the magnitude of a charging bias voltage, the magnitude of a developing bias voltage, the magnitude of a transfer bias voltage, or the like and thus, the density of an actually printed image may be different from the density of a desired image. Image density correction may be required to reduce a difference between the density of the desired image and the density of the actually printed image.

In an example, the image density correction may include a process of forming a toner image for density correction to which a reference density value is applied, detecting a density value of the toner image for density correction, comparing the density value with the reference density value to calculate a density error, and determining printing parameters, such as a charging bias voltage, a developing bias voltage, or a transfer bias voltage, for correcting the density error.

The controller 500 may control the image forming unit 100 to form a toner image for density correction, detect a density value of the toner image for density correction by using the photodetector 400, compare the detected density value with a reference density value to calculate a density error, and determine printing parameters for correcting the density error.

Figure 8:
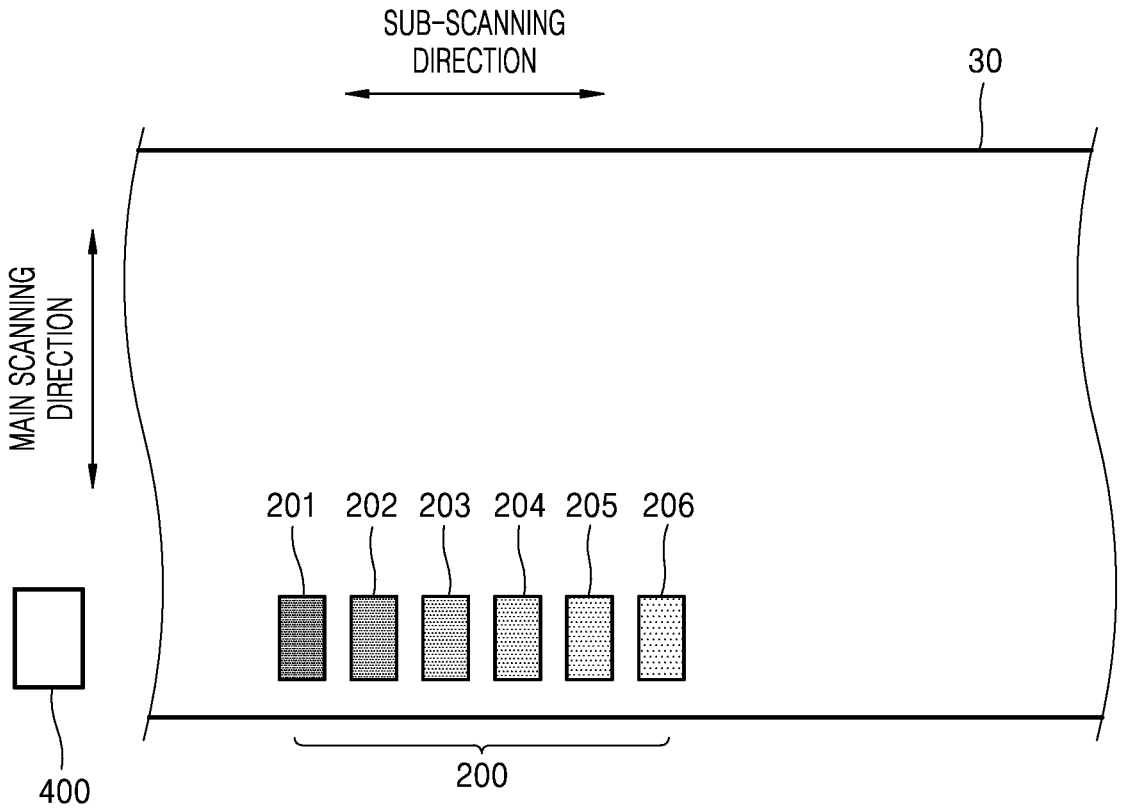
FIG. 8 is a view showing a toner image for density correction according to an example.

FIG. 8 is a view showing a toner image for density correction according to an example.

Referring to FIG. 8, a toner image 200 for density correction may include a plurality of density patches 201, 202, 203, 204, 205, and 206 to which different reference density values are applied. The plurality of density patches 201 to 206 may be arranged in a sub-scanning direction. The sub-scanning direction is a direction corresponding to a transport direction of the print medium P. The plurality of density patches 201 to 206 may be formed in an image area or a non-image area in a main scanning direction. The reference density values of the plurality of density patches 201 to 206 may be sequentially increased or decreased. Although six density patches are shown in FIG. 8, the present disclosure is not limited thereto and the number of density patches may be less than or greater than six.

Actual density values of the plurality of density patches 201 to 206 may be different from the reference density values. The actual density values of the plurality of density patches 201 to 206 may be detected by an optical detection method. The printer is provided with a photosensor for density correction. The photosensor for density correction may detect the toner image 200 for density correction on the photosensitive drum 1, the intermediate transfer belt 30, or the print medium P before or after passing through the fusing unit 60. According to an example, the photodetector 400 may be used as a photosensor for density correction.

The photodetector 400 irradiates light in an invisible wavelength band to the plurality of density patches 201 to 206 on the photosensitive drum 1, the intermediate transfer belt 30, or the print medium P before or after passing through the fusing unit 60, and receives light reflected from the plurality of density patches 201 to 206. A detection signal of the light receiving unit 420 is converted into a digital value by the A/D converter 510 and the digital value is input to the controller 500. The controller 500 calculates density values (detection density values) of the plurality of density patches 201 to 206 from a digital value of the detection signal. The controller 500 compares the detected density values with reference density values stored in advance in the memory 520 to calculate a density error. As an example, the controller 500 may form, by using the detected density values, an image curve in which a reference density value and a detected density value are set as a horizontal axis and a vertical axis, respectively. The controller 500 may calculate the slope of the image curve and calculate a density error by comparing the calculated slope to a reference slope previously stored in the memory 520.

The controller 500 determines printing parameters for correcting the density error and the determined printing parameters may be stored in the memory 520. The controller 500 may control the image forming unit 100 to print an image by applying the determined printing parameters. Thus, an image having a desired density may be printed.

As described above, according to an example, the photodetector 400 may function as a sensor for determining the type of toner and also a sensor for image density correction. Thus, a material cost of the printer may be reduced.

The precision of the image density correction may depend on how precisely the density value of the toner image 200 for density correction is detected. In an example, a printer uses a toner containing fluorescent additives that reflect light in a certain wavelength band in response to light in an invisible wavelength band. Since the toner receives light in an invisible wavelength band and reflects light in a certain wavelength band, it is possible to detect an accurate density value, which is not influenced by the color of a toner image, by detecting only the light in the certain wavelength band reflected by the fluorescent additives by using the photodetector 400. Furthermore, as reflected light detected employing the optical filter 430 limits a wavelength band, it is possible to detect a more accurate density value.

While one or more examples have been described with reference to the figures, it will be understood by those of ordinary skill in the art that various changes in form and details may be made therein without departing from the spirit and scope as defined by the following claims.

What is claimed is:

1. A photodetector for detecting fluorescent toner, the photodetector comprising:

a light emitting unit to emit light to a toner image, and a light receiving unit to:

detect visible light reflected by the toner image, the visible light having a wavelength band of about 450 nanometers (nm) to about 700 nm, detect that the toner image includes the fluorescent toner based on the detection of the visible light, the visible light generated by the fluorescent toner and having a predetermined wavelength band different from a wavelength band of the emitted light, and output a signal corresponding to the detection of the fluorescent toner.

2. The photodetector of claim 1, wherein the light emitting unit is to emit light in an invisible wavelength band.

3. The photodetector of claim 2, wherein the light emitting unit is to emit ultraviolet light or infrared light.

4. The photodetector of claim 1, wherein the light receiving unit is to detect visible light that is scattered, the scattered light having a reflection angle different from an angle of incident light with respect to a line perpendicular to the toner image.

5. The photodetector of claim 1, wherein the light receiving unit is to detect visible light having a bandwidth of 60 nm or less in the wavelength band of about 450 nm to about 700 nm.

6. The photodetector of claim 1, wherein the light receiving unit is to detect visible light having a bandwidth of 40 nm or less in the wavelength band of about 450 nm to about 700 nm.

7. The photodetector of claim 1, further comprising an optical filter located at a front end of the light receiving unit to limit a wavelength band of light incident on the light receiving unit.

8. The photodetector of claim 1, wherein a type of the fluorescent toner is detectable based on the predetermined wavelength band of the generated visible light.

9. The photodetector of claim 8, wherein the light receiving unit is to output a detection signal corresponding to the type of the fluorescent toner.

10. The photodetector of claim 1, wherein the light receiving unit is to detect visible light generated by quantum dots included in the fluorescent toner.

11. The photodetector of claim 10, wherein the light receiving unit is to detect visible light generated by quantum dots treated with a nonionic organic dispersant or including a halogen-based element added to an organic ligand on a surface of the quantum dots.

12. The photodetector of claim 1, wherein a distance between the light emitting unit and the light receiving unit is about 30 millimeters.

13. The photodetector of claim 1, wherein the light receiving unit is to detect visible light reflected by the toner image located on a photosensitive drum, an intermediate transfer belt, or a print medium.

14. A photodetector for detecting fluorescent toner of a security document, the photodetector comprising:

a light emitting unit to emit light to a toner image of the security document; and a light receiving unit to:

detect visible light reflected by the toner image of the security document, the visible reflected light having a reflection angle different from angle of incident light with respect to a line perpendicular to the toner image and having a wavelength band of about 450 nanometers (nm) to about 700 nm, detect whether the visible reflected light has a predetermined wavelength band different from a wavelength band of the emitted light, and output a detection signal based on the visible reflected light having the predetermined wavelength band different from the wavelength band of the emitted light.

15. The photodetector of claim 14, wherein the toner image of the security document is generated using a white toner or a transparent toner.

16. The photodetector of claim 15, wherein the white toner or the transparent toner includes a fluorescent additive to generate the visible reflected light having the predetermined wavelength band.

17. The photodetector of claim 14, wherein the toner image of the security document includes identification information of the security document, identification information of a user printing the security document, identification information of a user generating the security document, or identification information of a location of the security document.

18. The photodetector of claim 14, wherein the light receiving unit is to, based on the visible reflected light not having the predetermined wavelength band different from the wavelength band of the emitted light, output a signal to stop a printing process.

19. A photodetector for detecting fluorescent toner, the photodetector comprising:

a light emitter to emit light in an invisible wavelength band to a toner image on an image receptor, the toner image formed using a toner containing fluorescent additives for generating visible light in a predetermined wavelength band in response to the light in the invisible wavelength band; and a light receiver to detect the generated visible light having a wavelength band of about 450 nm to about 700 nm, and to output a signal corresponding to the predetermined wavelength band of the generated visible light.

20. The photodetector of claim 19, wherein the toner image includes a detection toner image formed in a non-image area of the image receptor, and the photodetector is positioned to face the non-image area.

* * * * *